United States Patent [19]

Cousins

[11] 4,062,164

[45] Dec. 13, 1977

[54] CEILING PANEL SECURING DEVICE

[75] Inventor: Charles Cousins, Placentia, Calif.

[73] Assignee: Hughes Aircraft Company, Culver City, Calif.

[21] Appl. No.: 758,234

[22] Filed: Jan. 10, 1977

[51] Int. Cl.[2] ..... E04B 5/52

[52] U.S. Cl. ..... 52/489; 52/499; 49/465

[58] Field of Search ..... 52/489–499, 52/500, 474, 27, 220; 292/202; 49/465

[56] References Cited

U.S. PATENT DOCUMENTS

| | | | |
|---|---|---|---|
| 2,151,934 | 3/1939 | Parrott | 292/202 |
| 3,303,624 | 2/1967 | Swain | 52/496 |
| 3,828,508 | 8/1974 | Moeller | 52/489 |

*Primary Examiner*—J. Karl Bell

*Attorney, Agent, or Firm*—Allen A. Dicke, Jr.; W. H. MacAllister

[57] ABSTRACT

In suspended ceiling construction, a series of inverted T-bars are suspended from the overhead and ceiling panels rest upon the crosspiece which forms the head of the T-bar. The ceiling panel securing device engages around the edge of the ceiling panel and under the T-bar to hold the ceiling panel down so that the room cannot be entered through the ceiling without detection.

5 Claims, 3 Drawing Figures

CEILING PANEL SECURING DEVICE

BACKGROUND

This invention is directed to a ceiling panel securing device for securing the ceiling panels in suspended ceiling construction down against the T-bar, to provide security for the space below the ceiling.

Suspended ceiling construction is well known and is widely used in finishing office and other work space. Suspended ceiling-type of construction has the particular advantage of having a large plenum above the ceiling for ventilation air, duct work, and electrical and other conduits. In order to attractively finish this plenum, a celing for the occupied space below is required. A convenient type of construction is the suspended ceiling. In this suspended ceiling construction, T-shaped bars are suspended from the overhead in inverted position. These T-bars are modularly positioned so that a ceiling panel may rest upon the cross-bars of the T's in each opening. Thus, a ceiling of attractive appearance is produced. Since the panel may be readily lifted, easy access to the plenum is achieved. The ceiling panels are usually produced of fibrous material of acoustic value, and the character of the work space is thus further enhanced.

A disadvantage of the suspended is that the panels may be readily lifted out of their T-bar supports to permit access to the room from the plenum, and such access is without evidence that entry has been made. When the work space is to be made safe against unknown entry for reasons of physical property, proprietary data, trade secrets, or government security, the ceiling panels must be secured in place. The present manner in which that security is accomplished is to use a U-bolt with four nuts, four washers and a bottom cross strap. The U-bolt is dropped down through drilled holes in adjacent ceiling panels on opposite sides of a T-bar with a nut and washer on each leg of the U-bolt above the panel. Below the panel, the strap is installed on both legs of the U-bolt underneath the T-bar and two more washers and nuts are applied. Now, the adjacent ceiling panels are strapped to the T-bar. This method is cumbersome and requires drilling two holes in ceiling panels for each U-bolt.

Accordingly, there is need for a ceiling panel securing device which can be easily applied, is economic and secures the ceiling panel down to the T-bar so that entry through the ceiling from above can be detected.

SUMMARY

In order to aid in the understanding of this invention, it can stated in essentially summary form that it is directed to a ceiling panel securing device for securing a ceiling panel down in a suspended ceiling construction which includes a T-bar which comprises a U-shaped clip which engages around the edge of the ceiling panel and a turncatch pivotly attached to the clip which can be rotated from a position away from the T-bar to a position where it engages under the T-bar so that the clips can be attached to the ceiling panel, the ceiling panel put in place and the turncatches are then turned under the T-bar to hold the ceiling panel in place.

It is thus an object of this invention to provide a ceiling panel securing device which holds a ceiling panel down to its supporting T-bar so that access from the plenum into the room below cannot be accomplished without detectable destruction of the ceiling panel, the T-bar or the securing device. It is a further object to provide a device which provides security in the space below a suspended ceiling structure. It is another object to provide a ceiling securing device which has a clip for engaging around the edge of a ceiling panel, and a turncatch rotatably mounted on the clip for swinging from a position away from the T-bar to a position under the T-bar.

Other objects and advantages of this invention will become apparent from a study of the following portion of this specification, the claims and the attached drawings.

DESCRIPTION OF THE PREFERRED EMBODIMENT

Figure 1:
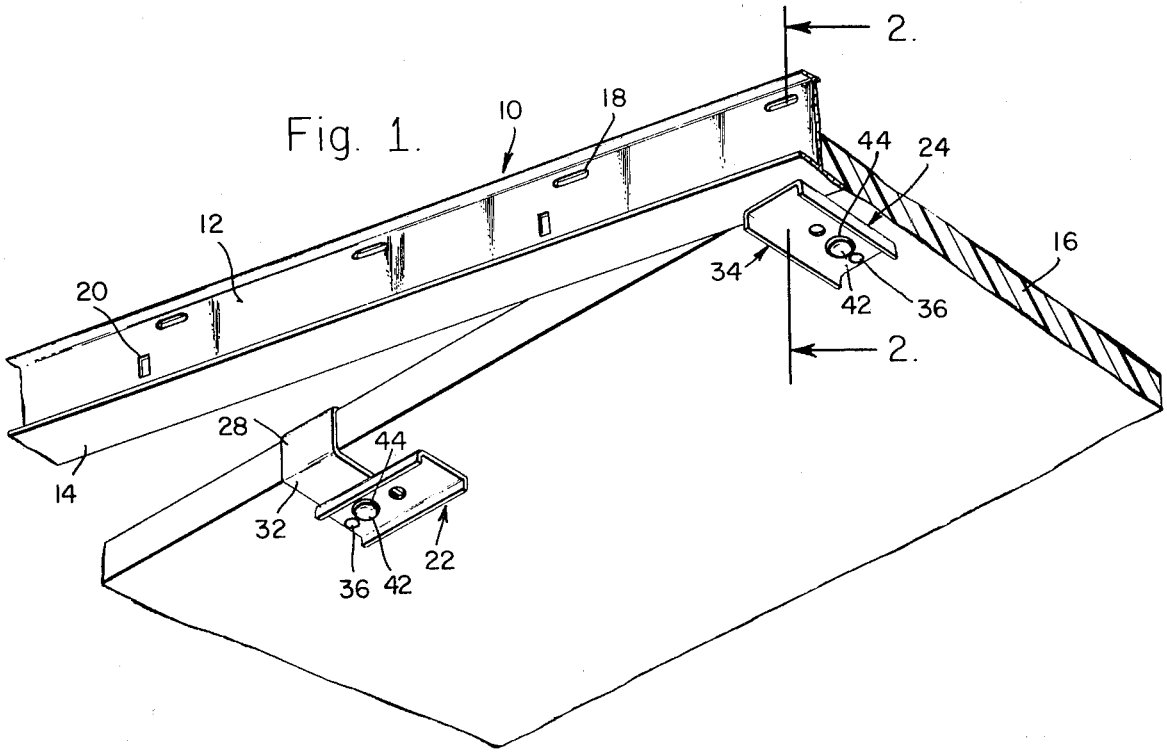
FIG. 1 is a perspective view from a position below a suspended ceiling, showing ceiling panel securing devices in accordance with this invention attached to the edge of a ceiling panel which is swung away from its T-bar.
Figure 2:
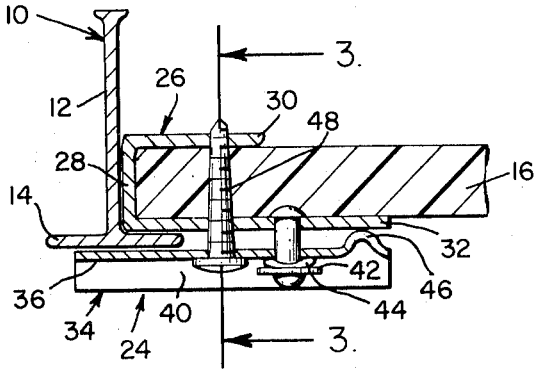
FIG. 2 is an enlarged section taken generally only along line 2—2, FIG. 1, showing a section through the T-bar, the ceiling panel securing clip and the associate ceiling panel.
Figure 3:
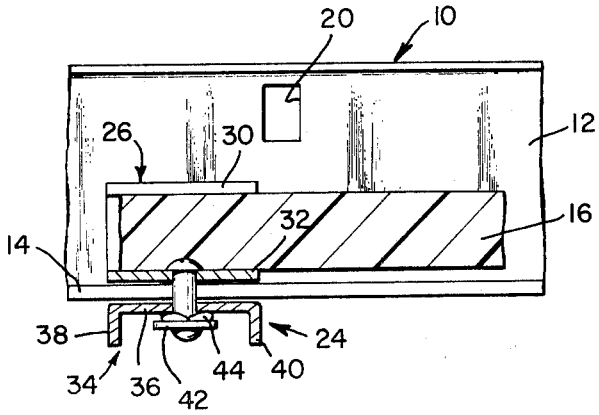
FIG. 3 is a section taken generally along line 3—3 of FIG. 2.

Conventional suspended ceiling structures include T-bar 10 as a principle structural element see FIGS. 1, 2, and 3. T-bar 10 has web 12 and head 14 which provides opposing outwardly extending flanges. With the head on the bottom of the T-bar 10 as illustrated, a ceiling panel, such as ceiling panel 16 may rest upon the opposite outwardly extending flanges of the head of the T-bar.

T-bar 10 includes attachment slots 18 through which wires attached to the overhead at the top of the plenum are passed and secured. By means of adjusting and securing a series of the suspending wires, the T-bars are leveled and supported. Cross-bar notches 20 are positioned through the web of the T-bar so that cross T-bars can be located on modular centers to provide the correct longitudinal spacing for the cross T-bars and to provide supports for the ends of the ceiling panels, such as conventional suspended ceiling structure. The ceiling tile panels lie upon the cross-bars of the suspended T-bars. The ceiling tile panels effectively provide acoustic and appearance closure of the top of the room below the ceiling but it is clear that the ceiling tile panels may be readily lifted out of the T-bar support.

When such a room is to be used to house government classified materials or other property to be protected, there must be a method of securing the ceiling tile panels that will deter entry and show evidence should an intrusion into the room be made through the ceiling. The ceiling panel securing device of this invention has been arranged to retain such ceiling panels in place so that the ceiling panels cannot be removed from above without visible damage. Ceiling panel securing devices 22 and 24 are illustrated in FIG. 1, and are identical, while ceiling panel securing device 24 is shown in more detail in FIGS. 2 and 3.

Device 24 has a U-shaped clip 26 which is dimensioned to engage around the edge of ceiling tile panel 16. It has end piece 28 which reaches across the edge of the ceiling tile panel, top finger 30 which extends part way across the top surface of ceiling tile panel 16 and bottom flange 32 which extends across the undersurface of the ceiling tile panel for a short distance away from the head 14 of the T-bar. Turncatch 34 is channel shaped with web 36 and down-turned flanges 38 and 40.

Rivet 42 engages through bottom flanges 32 and web 36. The hole in web 36 through which it extends is sufficiently large to permit limited freedom of motion of the turncatch, to the extent of free rotation around the axis of the pivot and the certain amount of the rocking at right angles to that axis. Rivet 42 has a head above bottom flange 32 and is preferably firmly riveted into bottom flange 32 so that the rivet is secured with respect thereto. Rivet 42 also has a lower head beneath web 36, and between this lower head and web 36 is wave washer 44. Wave washer 44 is bent to urge turnbuckle 34 toward clip 26. The hole in turncatch 34 through which rivet 42 extends is positioned at about one-third the length of the turncatch from one end thereof. The short end carries dimple 46 facing upward to provide spacing between the short end of the turncatch and the lower surface of clip 26. The height of the dimple is about equal to the thickness of head 14.

As is seen in FIG. 2, the proportions of the construction are such that when the clip is attached over the edge of a ceiling tile panel, turncatch 34 can be turned under head 14. Spring 44 urges the turncatch upward to prevent any looseness in the structure. When several of the ceiling panel securing devices are attached over the edge of a panel, that is at least three such securing devices are attached over at least two opposite edges of the panel, and have their turncatches turned under the adjacent T-bar head, then the panel cannot be removed from above without visible damage to some of the parts. Thus, evidence of intrusion into the room through the ceiling is provided to provide security.

In order to further enhance the security by positively clamping the securing device on the T-bar, holes are provided through web 36, bottom flange 32 and top finger 30. These holes are aligned when the turncatch is turned into engagement position, as shown in FIGS. 2 and 3. The holes through web 36 and bottom flange 32 are clearance holes for a sheet metal screw, while the hole in top finger 30 is of such size for tapping in the sheet metal screw 48. In this way, sheet metal screw 48 both locks the turncatch in the engaged rotative position and clamps the turncatch against the clip to clamp the head of the T-bar therebetween for improved security.

This invention having been described in its preferred embodiment, it is clear that is susceptible to numerous modifications and embodiments within the ability of those skilled in the art and without the exercise of the inventive faculty. Accordingly, the scope of this invention is defined by the scope of the following claims.

What is claimed is:

1. A ceiling panel securing device for securing a ceiling panel to its supporting framework in a suspended ceiling construction, said ceiling panel securing device comprising:

means for engaging over a ceiling panel which is resting on suspended ceiling supporting framework; a rotatable turncatch movable from a position where it is away from the framework to a position where it engages under the framework.

2. The ceiling panel of claim 1 wherein there are aligned holes in said turncatch and in said engaging means to permit placement of a security screw through said holes when said turncatch is in supporting framework engagement position.

3. A ceiling panel securing device for securing a ceiling panel to its inverted T-bar framework in suspended ceiling construction, said ceiling panel securing device comprising:

a U-shaped clip for engaging over the edge of a ceiling panel which is resting on suspended ceiling supporting framework, said U-shaped clip having a top finger for extending on top of the ceiling panel and a bottom flange for extending below the ceiling panel to embrace the edge of the ceiling panel in position so that the bottom flange engages on the inverted T-bar supporting framework when the U-shaped clip is engaged on the edge of a ceiling panel and the ceiling panel is positioned in its supporting framework;

a pivot member engaged in said bottom flange;

a turncatch pivotly mounted on said pivot member so that said turncatch is rotatably supported under said bottom flange, said turncatch being curved to hold one end of said turncatch spaced away from said bottom flange for engagement under the T-bar;

a spring engaged between said pivot member and said turncatch to urge said turncatch toward said bottom flange so that when said turncatch is engaged on a ceiling panel mounted on a supporting T-bar framework with said turncatch engaged under the T-bar, the ceiling panel is held down so that the ceiling panel cannot be raised from above without visible damage.

4. The ceiling panel securing device of claim 3 wherein said curved portion of said turncatch is a dimple in said turncatch, said dimple being of substantially the same height as the thickness of the head of the T-bar.

5. The ceiling panel of claim 4 wherein there are aligned holes in said turncatch and in said clip to permit placement of a security screw through said holes when said turncatch is in T-bar engagement position.

* * * * *